US010193210B2

(12) United States Patent
Chen et al.

(10) Patent No.: US 10,193,210 B2
(45) Date of Patent: Jan. 29, 2019

(54) TERMINAL DEVICE HAVING HYBRID ANTENNA INTEGRATING WITH CAPACITIVE PROXIMITY SENSORS

(71) Applicant: TAIWAN ANJIE ELECTRONICS CO., LTD, Hsinchu (TW)

(72) Inventors: Yen-Cheng Chen, Hsinchu (TW); Yeh-Chian Lin, Hsinchu (TW)

(73) Assignee: TAIWAN ANJIE ELECTRONICS CO., LTD., Hsinchu (TW)

( * ) Notice: Subject to any disclaimer, the term of this patent is extended or adjusted under 35 U.S.C. 154(b) by 118 days.

(21) Appl. No.: 15/392,022

(22) Filed: Dec. 28, 2016

(65) Prior Publication Data

US 2018/0183131 A1 Jun. 28, 2018

(51) Int. Cl.

| | |
|---|---|
| ***H01Q 1/00*** | (2006.01) |
| ***H01Q 1/22*** | (2006.01) |
| ***H01Q 1/24*** | (2006.01) |
| ***H01Q 1/48*** | (2006.01) |
| ***H01Q 9/42*** | (2006.01) |
| ***H01Q 5/371*** | (2015.01) |

(52) U.S. Cl.

CPC ..... *H01Q 1/22* (2013.01); *H01Q 1/243* (2013.01); *H01Q 1/48* (2013.01); *H01Q 5/371* (2015.01); *H01Q 9/42* (2013.01)

(58) Field of Classification Search

CPC .. H01Q 1/44; H01Q 1/46; H01Q 5/00; H01Q 7/00; H01Q 1/38

USPC ..... 343/720, 852, 702, 866

See application file for complete search history.

(56) References Cited

U.S. PATENT DOCUMENTS

2014/0333494 A1* 11/2014 Huang ..... H01Q 1/002 343/720

2015/0077307 A1* 3/2015 Liou ..... H01Q 7/00 343/861

* cited by examiner

*Primary Examiner* — Dameon E Levi
*Assistant Examiner* — Collin Dawkins
(74) *Attorney, Agent, or Firm* — Schmeiser, Olsen & Watts, LLP

(57) ABSTRACT

A terminal device having hybrid antenna integrating with capacitive proximity sensors comprises a ground, a radiator, a first capacitance electrode and a second capacitance electrode. The radiator has a feeding portion, a low-frequency radiating path and a high-frequency radiating branch. The low-frequency radiating path has a first coupling portion. The feeding portion is disposed between the first coupling portion and the ground. The high-frequency radiating branch acts as a second coupling portion. The first capacitance electrode has a first shorting portion and a first electrode portion. The first shorting portion is connected to the ground. The first electrode coupling with the first coupling portion generates a first coupling resonant mode. The second capacitance electrode has a second shorting portion and a second electrode portion. The second shorting portion is connected to the ground. The second electrode coupling with the high-frequency radiating branch generates a second coupling resonant mode.

9 Claims, 7 Drawing Sheets

TERMINAL DEVICE HAVING HYBRID ANTENNA INTEGRATING WITH CAPACITIVE PROXIMITY SENSORS

FIELD OF THE INVENTION

The present invention relates to terminal devices with an antenna and, more particularly, to a terminal device having a hybrid antenna integrating with capacitive proximity sensors.

BACKGROUND OF THE INVENTION

Terminal devices, which come into contact with a human body (such as the hand or the head) when in use, are governed by safety regulations which stipulate the allowable degree of negative effects of electromagnetic waves on the human body. However, terminal devices capable of wireless communication are expected to be effective in providing wireless communication. Hence, both human body safety and wireless communication capability must be taken into account.

In general, a conventional proximity sensing device is deemed a solution to the aforesaid issue. The proximity sensing device is designed to sense whether a human body is approaching the terminal device and thus generate a corresponding sensing message. Therefore, when the proximity sensing device senses that a human body is approaching (or in contact with) the terminal device, a control circuit changes the present operating mode of a wireless unit and thereby alters electromagnetic radiation, with a view to complying with the safety regulations. By contrast, when the proximity sensing device senses that no human body is approaching (or in contact with) the terminal device, the terminal device is switched to the operating mode most favorable to wireless communication.

SUMMARY OF THE INVENTION

It is an objective of the present invention to provide a terminal device having a hybrid antenna integrating with capacitive proximity sensors, and the hybrid antenna is capable of proximity sensing and operating as an antenna simultaneously.

In order to achieve the above and other objectives, the present invention provides a terminal device having a hybrid antenna integrating with capacitive proximity sensors, the terminal device comprising: a ground portion; a radiator having a feeding portion, a low-frequency radiating path, and a high-frequency radiating branch, the low-frequency radiating path having a first coupling portion, the feeding portion being disposed between the first coupling portion and the ground portion, the high-frequency radiating branch functioning as a second coupling portion; a first capacitor electrode having a first shorting portion and a first electrode portion, the first shorting portion being connected to the ground portion, wherein the first electrode portion is coupled to the first coupling portion of the low-frequency radiating path to generate a first coupling resonant mode; and a second capacitor electrode having a second shorting portion and a second electrode portion, the second shorting portion being connected to the ground portion, wherein the second electrode portion is coupled to the high-frequency radiating branch to generate a second coupling resonant mode.

In an embodiment of the present invention, the terminal device is a smartphone, a notebook computer, or a tablet.

In an embodiment of the present invention, the first capacitor electrode and the second capacitor electrode are disposed on opposing sides of the radiator, respectively.

In an embodiment of the present invention, the first capacitor electrode is disposed on a first side of the ground portion, and the second capacitor electrode is disposed on a second side of the ground portion.

In an embodiment of the present invention, the low-frequency radiating path of the radiator generates a low-frequency resonant mode, and the high-frequency radiating branch of the radiator generates a high-frequency resonant mode, the low-frequency resonant mode having a lower frequency than the high-frequency resonant mode.

In an embodiment of the present invention, the first coupling resonant mode has a higher frequency than the second coupling resonant mode.

In an embodiment of the present invention, a frequency band at which the low-frequency resonant mode and the second coupling resonant mode operate is 824 MHz to 960 MHz, a frequency band at which the high-frequency resonant mode, the first coupling resonant mode, and an auxiliary resonant mode operate is 1710 MHz to 2170 MHz, and the auxiliary resonant mode at least comprises one of a first high-level mode of the second coupling resonant mode and a first high-level mode of the low-frequency resonant mode.

In an embodiment of the present invention, the radiator, the first capacitor electrode and the second capacitor electrode are formed on a microwave substrate.

In an embodiment of the present invention, the first coupling portion and the first electrode portion of the first capacitor electrode are disposed on an upper side of the microwave substrate, the second high-frequency branch which functions as the second coupling portion and the second electrode portion of the second capacitor electrode are disposed on the upper side of the microwave substrate, the first shorting portion and second shorting portion are disposed on a lower side of the microwave substrate, the first shorting portion is connected to the first electrode portion by a first through hole, and the second shorting portion is connected to the second electrode portion by a second through hole.

In an embodiment of the present invention, the low-frequency radiating path of the radiator further has a common path and a low-frequency radiating branch, the first coupling portion and the common path of the low-frequency radiating path, and the high-frequency radiating branch together surround the low-frequency radiating branch of the low-frequency radiating path, wherein the low-frequency radiating branch falls within a region jointly enclosed by the first coupling portion, the common path, the high-frequency radiating branch, and the ground portion.

In conclusion, the present invention provides a terminal device having a hybrid antenna integrating with capacitive proximity sensors to perform proximity sensing at different points of the terminal device, so as to not only increase a sensing range (or precision), but also provide a hybrid antenna which includes capacitor electrodes in order to be applicable to multi-band operation.

Technical features and technical solutions of the present invention are described below with reference to accompanying drawings. However, the description below and the accompanying drawings are illustrative of the present invention rather than restrictive of the claims of the present invention.

DETAILED DESCRIPTION OF THE PREFERRED EMBODIMENTS

The terminal device of the present invention is a smartphone, a notebook computer, a tablet, or any terminal device that requires a user to perform proximity sensing, but the present invention is not limited thereto. The aforesaid proximity sensing is based on capacitive proximity sensing technology and adapted to sense whether any external object, such as a human body, is approaching the terminal device, so as to switch to a desirable antenna radiation state and thereby reduce the negative effects on the human body. The terminal device having a hybrid antenna integrating with capacitive proximity sensors essentially comprises a ground portion 2 and a hybrid antenna which integrates with capacitive proximity sensors (hereinafter referred to as the hybrid antenna). The hybrid antenna comprises a radiator 1, a first capacitor electrode 3, and a second capacitor electrode 4. The radiator, first capacitor electrode, and second capacitor electrode are usually made of a metal, such as copper. The ground portion 2 is exemplified by a system ground to the terminal device or a ground surface for an internal circuit board, but the present invention is not limited thereto.

Figure 1:
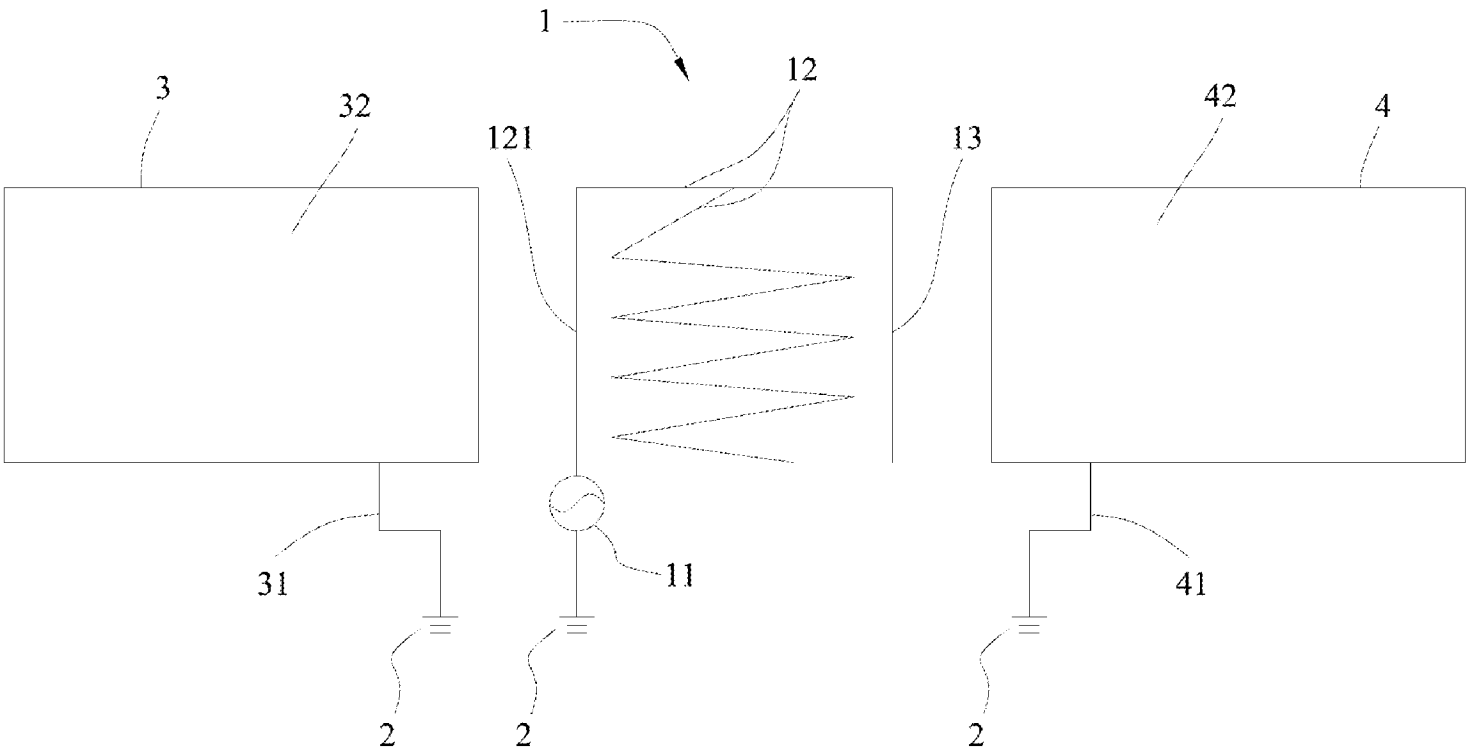
FIG. 1 is a schematic view of a terminal device having a hybrid antenna integrating with capacitive proximity sensors according to an embodiment of the present invention.

Referring to FIG. 1, it is a schematic view of a terminal device having a hybrid antenna integrating with capacitive proximity sensors according to an embodiment of the present invention. For the sake of brevity, the ground portion 2 in FIG. 1 is denoted by a conventional symbol for a ground.

The radiator 1 has a feeding portion 11, a low-frequency radiating path 12, and a high-frequency radiating branch 13. The feeding portion 11 provides radio frequency signals to the low-frequency radiating path 12 and the high-frequency radiating branch 13. The low-frequency radiating path 12 has a first coupling portion 121. The feeding portion 11 is disposed between the first coupling portion 121 and the ground portion 2. The high-frequency radiating branch 13 functions as a second coupling portion. The first capacitor electrode 3 has a first shorting portion 31 and a first electrode portion 32. The first shorting portion 31 is connected to the ground portion 2. The first electrode portion 32 is coupled to the first coupling portion 121 of the low-frequency radiating path 12 to generate a first coupling resonant mode. The second capacitor electrode 4 has a second shorting portion 41 and a second electrode portion 42. The second shorting portion 41 is connected to the ground portion 2. The second electrode portion 42 is coupled to the high-frequency radiating branch 13 to generate a second coupling resonant mode. Although, in this embodiment, the feeding portion 11, first shorting portion 31, and second shorting portion 41 are connected to the ground portion 2, the feeding portion 11, first shorting portion 31, and second shorting portion 41 are connected to different points of the ground portion 2, respectively. The first capacitor electrode 3 and the second capacitor electrode 4, which are located differently relative to the ground portion 2, use the first electrode portion 32 and the second electrode portion 42 to perform proximity sensing at different points. Unlike the prior art which discloses a single proximity sensor, this embodiment of the present invention discloses multiple proximity sensors and thus provides a wider proximity sensing range, thereby enhancing sensing precision. Moreover, the present invention is not restricted to two capacitor electrodes, and in consequence a change in the bending paths of the low-frequency radiating path 12 and the high-frequency radiating branch 13 can increase a region (or point) which energy is coupled to, so as to appropriately introduce a third (or even fourth, and so on) capacitor electrode to provide multiple (including, two, three or more) capacitive proximity sensing regions (or points). Since the capacitor electrodes located at different points provide different capacitance sensing data (or parameters), respectively, so that the terminal device with two or more capacitive proximity sensors adapts to the control over multiple (two or more) proximity sensing modes. Capacitance values (and trends of variations in the capacitance values) of the capacitive proximity sensors vary with the structural design of the terminal device, which together with parameters and control configuration, can be altered by persons skilled in the art as needed and thus are not described herein for the sake of brevity. Since the first capacitor electrode 3 and the second capacitor electrode 4 are coupled to radio frequency signals, the radio frequency signals must be filtered from a sensing circuit connected to the first capacitor electrode 3 and the second capacitor electrode 4 to prevent interference.

Figure 2A:
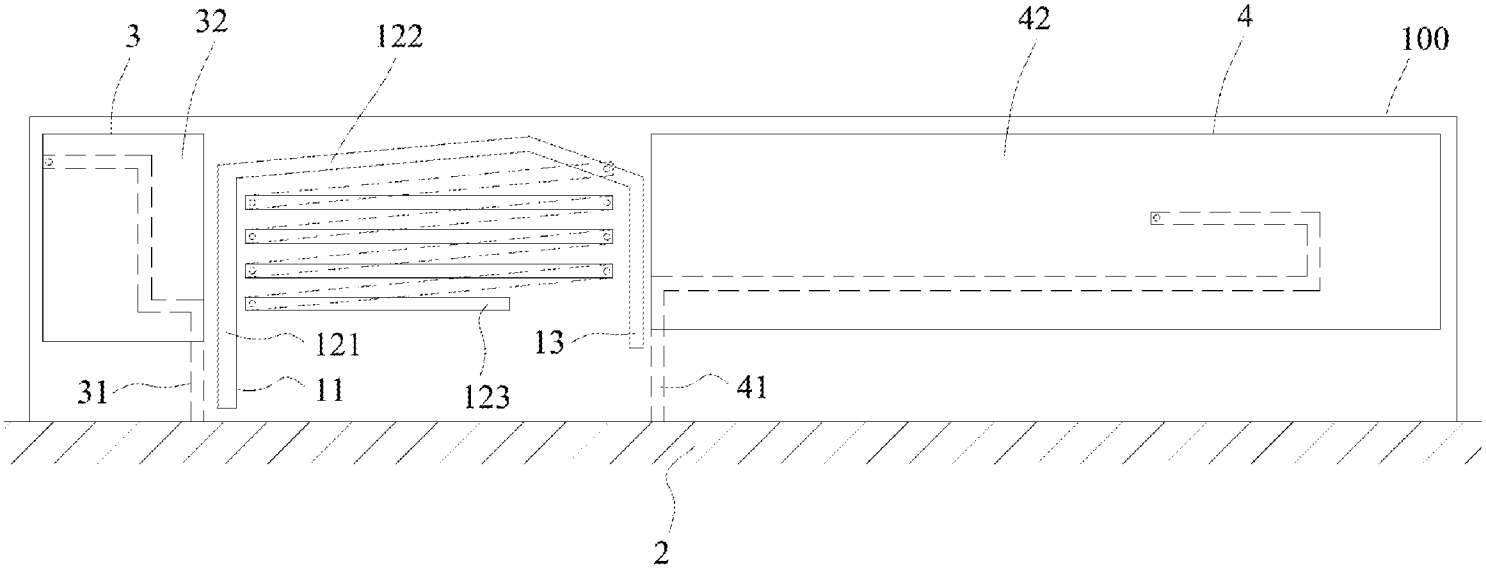
FIG. 2A is a front schematic view of the hybrid antenna which is disposed beside a ground portion of the terminal device and integrates with capacitive proximity sensors according to an embodiment of the present invention.
Figure 2B:
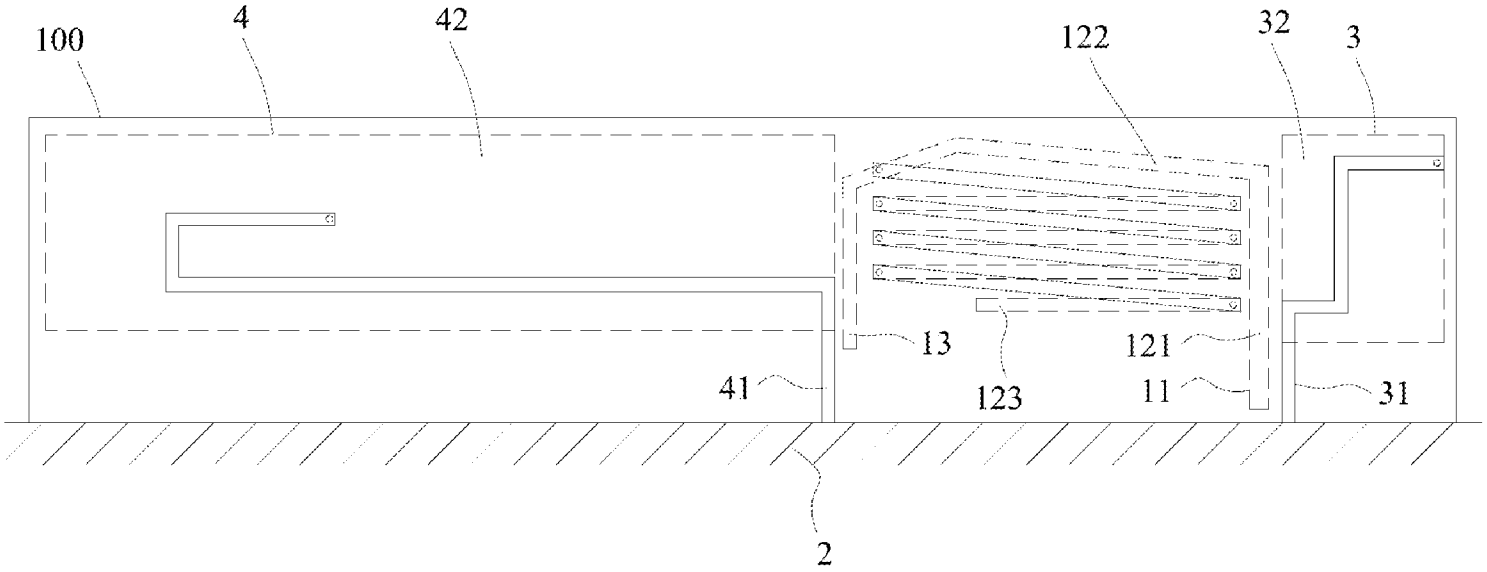
FIG. 2B is a rear schematic view of the hybrid antenna which is shown in FIG. 2A and integrates with capacitive proximity sensors according to an embodiment of the present invention.

Referring to FIG. 2A and FIG. 2B, FIG. 2A is a front schematic view of the hybrid antenna which is disposed beside a ground portion of the terminal device and integrates with capacitive proximity sensors according to an embodiment of the present invention, whereas FIG. 2B is a rear schematic view of the hybrid antenna shown in FIG. 2A. The hybrid antenna is disposed beside the ground portion 2. The hybrid antenna comprises the radiator 1, the first capacitor electrode 3, and the second capacitor electrode 4. The radiator 1, the first capacitor electrode 3, and the second capacitor electrode 4 are formed on the front and back (upper side and lower side) of a microwave substrate 100, for example, by double-sided printed circuit technology, to reduce the space taken up by the hybrid antenna in the terminal device. However, the present invention is not restrictive of embodiments of the hybrid antenna, as the hybrid antenna can also be manufactured by, for example, laser engraving or any related manufacturing process, to meet product requirements. The first capacitor electrode 3 and the second capacitor electrode 4 are disposed on the opposing sides of the radiator 1, respectively. Referring to FIG. 2A, the first capacitor electrode 3 is disposed on the left of the radiator 1, and the second capacitor electrode 4 is disposed on the right of the radiator 1. The feeding portion 11 of the radiator 1 is disposed on the upper side (front) of the microwave substrate 100 to connect with a radio frequency signal source through a connection transmission line (microstrip line or coaxial line). The low-frequency radiating path 12 of the radiator 1 is disposed on the front and back of the microwave substrate 100. The high-frequency radiating branch 13 of the radiator 1 is disposed on the upper side (front) of the microwave substrate 100. The low-frequency radiating path 12 of the radiator 1 generates a low-frequency resonant mode. The high-frequency radiating branch 13 of the radiator 1 generates a high-frequency resonant mode. The low-frequency resonant mode has a lower frequency than the high-frequency resonant mode. Referring to FIG. 2A (and FIG. 2B), the first coupling portion 121 of the low-frequency radiating path 12 is disposed on the upper side (front) of the microwave substrate 100, and the low-frequency radiating path 12 further has a common path 122 and a low-frequency radiating branch 123. The common path 122 is disposed on the upper side (front) of the microwave substrate 100. A portion of the low-frequency radiating branch 123 is disposed on the upper side (front) of the microwave substrate 100. A portion of the low-frequency radiating branch 123 is disposed on the lower side (back) of the microwave substrate 100. Conductive through holes are disposed on the front and back of the microwave substrate 100 to effectuate a spiral structure of the low-frequency radiating branch 123 in FIG. 2A (and FIG. 2B). In addition to the spiral structure, the low-frequency radiating branch 123 takes, for example, a meandering course, but the present invention is not restrictive of the shape of the low-frequency radiating branch 123. The high-frequency radiating branch 13 which functions as the second coupling portion is disposed on the upper side (front) of the microwave substrate 100, and the high-frequency radiating branch 13 is connected to the common path 122 of the low-frequency radiating path 12. In the embodiment of FIG. 2A, the first coupling portion 121 and the common path 122 of the low-frequency radiating path 12, and the high-frequency radiating branch 13 together surround the low-frequency radiating branch 123 of the low-frequency radiating path 12, whereas the low-frequency radiating branch 123 falls within a region jointly enclosed by the first coupling portion 121, the common path 122, the high-frequency radiating branch 13, and the ground portion 2, but the present invention is not limited thereto.

Referring to FIG. 2A and FIG. 2B, the first electrode portion 32 of the first capacitor electrode 3 is disposed on the upper side (front) of the microwave substrate 100, whereas the first shorting portion 31 of the first capacitor electrode 3 is disposed on the lower side (back) of the microwave substrate 100. The first shorting portion 31 is connected to the first electrode portion 32 by a through hole. The first shorting portion 31 is connected to the ground portion 2. The first electrode portion 32 is coupled to the first coupling portion 121 of the low-frequency radiating path 12 to generate a first coupling resonant mode. The extent to which energy is coupled to the capacitor electrodes depends on the shapes of and distance between the first electrode portion 32 and the first coupling portion 121. The first electrode portion 32 and the first shorting portion 31 together determine the resonant frequency of the first coupling resonant mode. The second electrode portion 42 of the second capacitor electrode 4 is disposed on the upper side (front) of the microwave substrate 100. The second shorting portion 41 of the second capacitor electrode 4 is disposed on the lower side (back) of the microwave substrate 100. The second shorting portion 41 is connected to the second electrode portion 42 by a through hole. The second shorting portion 41 is connected to the ground portion 2. The second electrode portion 42 is coupled to the high-frequency radiating branch 13 to generate a second coupling resonant mode. The extent to which energy is coupled to the capacitor electrodes depends on the shapes of and distance between the second electrode portion 42 and the high-frequency radiating branch 13 (second coupling portion). The second electrode portion 42 and the second shorting portion 41 together determine the resonant frequency of the second coupling resonant mode. The structure depicted by FIG. 2A is illustrative of the hybrid antenna rather than restrictive of the present invention. The first capacitor electrode 3 and the second capacitor electrode 4 are not necessarily disposed on the same side of the ground portion 2. The first capacitor electrode 3 and the second capacitor electrode 4 can be disposed on the opposing sides of the ground portion 2, respectively.

Figure 2C:
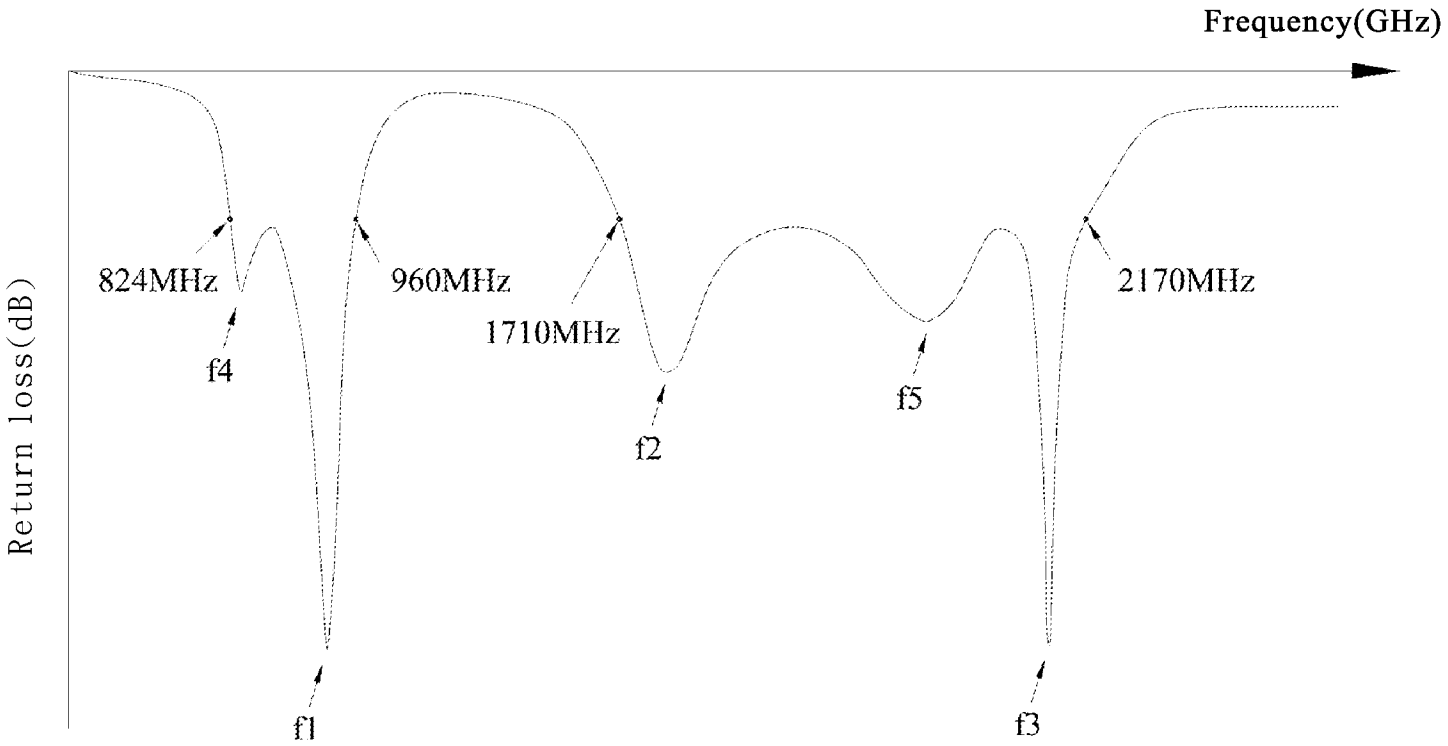
FIG. 2C is a graph of return loss of the hybrid antenna, which is shown in FIG. 2A and integrates with capacitive proximity sensors, against time.

The present invention is described herein with reference to FIG. 2A and FIG. 2C. FIG. 2C is a graph of return loss of the hybrid antenna shown in FIG. 2A against time. The low-frequency radiating path 12 of the radiator 1 generates a low-frequency resonant mode f1. The high-frequency radiating branch 13 of the radiator 1 generates a high-frequency resonant mode f2. The low-frequency resonant mode f1 has a lower frequency than the high-frequency resonant mode f2. A first coupling resonant mode f3 has a higher frequency than a second coupling resonant mode f4. An auxiliary resonant mode f5 has a frequency range which falls between that of the high-frequency resonant mode f2 and that of the first coupling resonant mode f3, for example, a first high-level mode of the second coupling resonant mode f4, a first high-level mode of the low-frequency resonant mode f1, or both, to be conducive to increasing the operating frequency range shared by the high-frequency resonant mode f2 and the first coupling resonant mode f3. The frequency band at which the low-frequency resonant mode f1 and the second coupling resonant mode f4 operate is, for example, 824 M Hz to 960 M Hz. The frequency band at which the high-frequency resonant mode f2, first coupling resonant mode f3 and auxiliary resonant mode operate is, for example, 1710 M Hz to 2170 M Hz. The auxiliary resonant mode at least comprises the first high-level mode of the second coupling resonant mode f4 or the first high-level mode of the low-frequency resonant mode f1. The aforesaid frequency ranges of the resonant modes are illustrative rather than restrictive of the present invention.

Figure 2D:
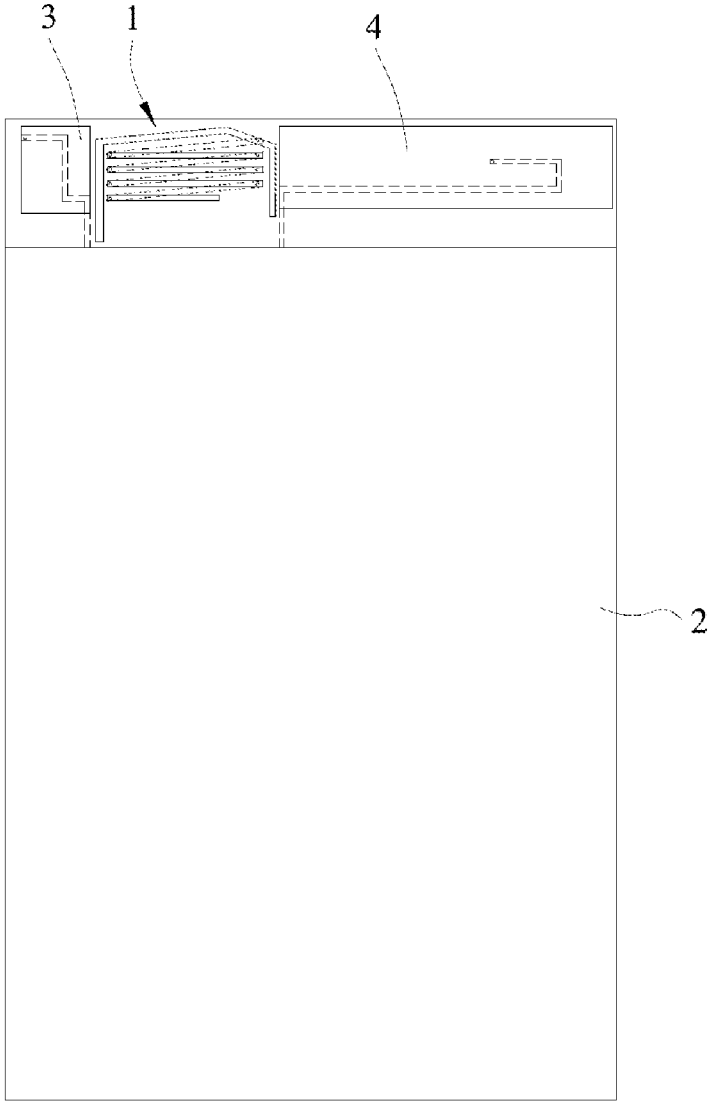
FIG. 2D is a schematic view of the terminal device having a hybrid antenna integrating with capacitive proximity sensors according to another embodiment of the present invention.

Referring to FIG. 2D, it is a schematic view of the terminal device having a hybrid antenna integrating with capacitive proximity sensors according to another embodiment of the present invention. As shown in the diagram, the terminal device is, for example, a handheld device (which is usually a smartphone). The ground portion 2, for example, is a ground surface for an internal circuit board of the handheld device. The first capacitor electrode 3 is disposed on the left of the ground portion 2 of the handheld device. The second capacitor electrode 42 is disposed on the right of the ground portion 2 of the handheld device. Therefore, the first capacitor electrode 3 and the second capacitor electrode 4 take care of proximity sensing at different points (left and right) of the handheld device, respectively. The first capacitor electrode 3 and the second capacitor electrode 42 each provide a coupling resonant mode to the hybrid antenna to increase the range of the operating frequency. In another embodiment, the first capacitor electrode is disposed on the first side of the ground portion, and the second capacitor electrode is disposed on the second side of the ground portion. The first and second sides of the ground portion are adjacent sides of the ground surface or spaced-apart sides of the ground surface.

Figure 3:
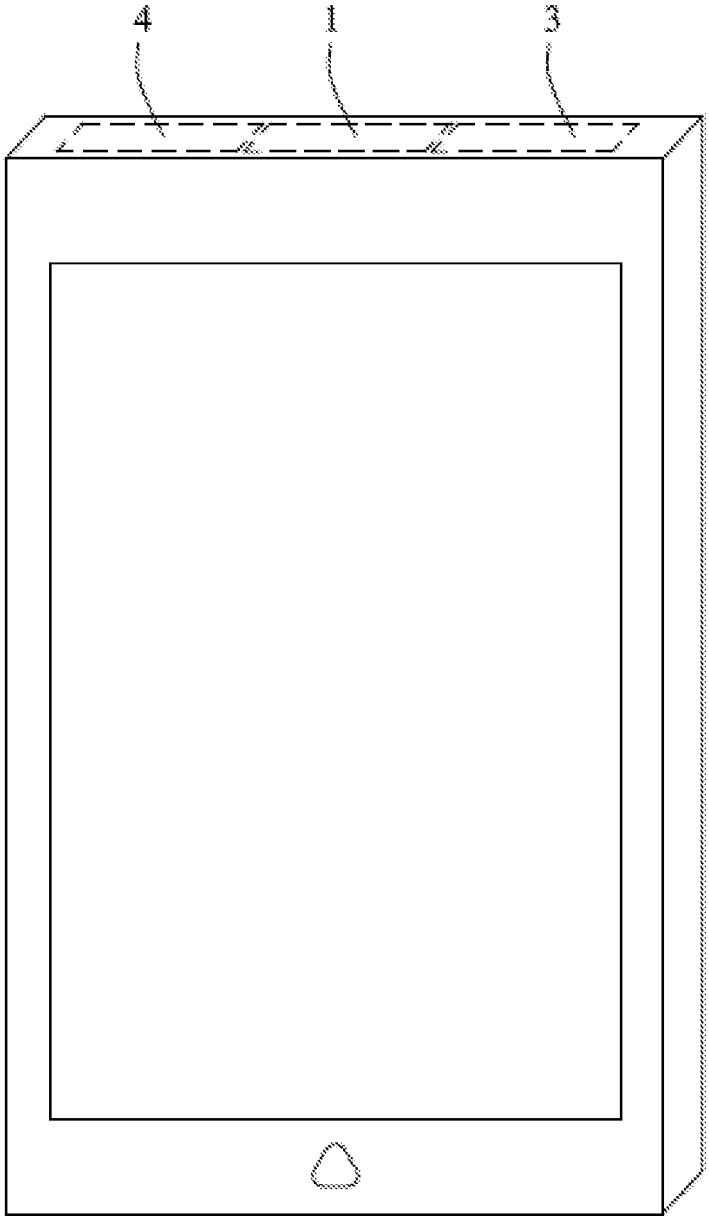
FIG. 3 is a schematic view of the terminal device having a hybrid antenna integrating with capacitive proximity sensors according to yet another embodiment of the present invention.
Figure 4:
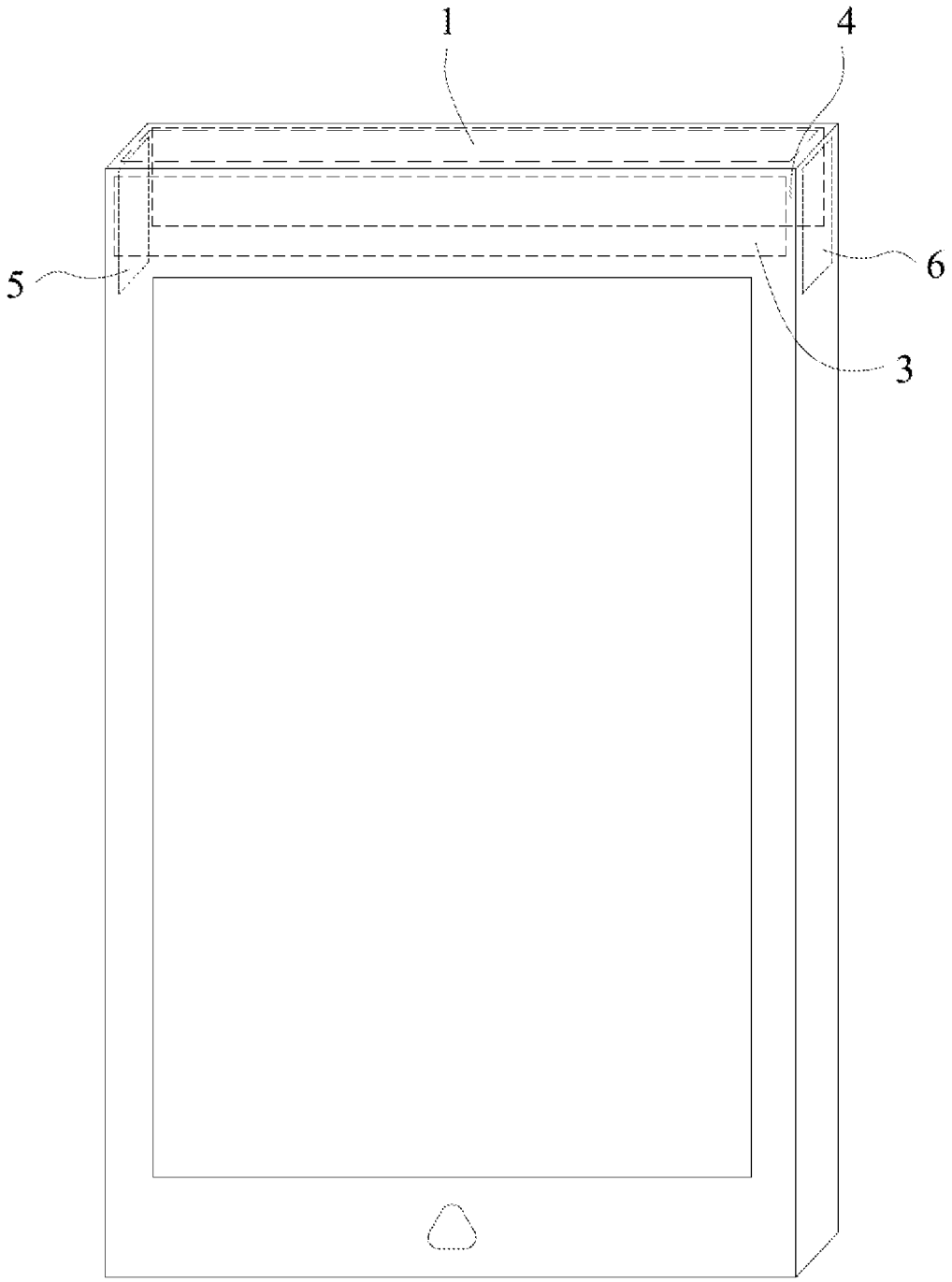
FIG. 4 is a schematic view of the terminal device having a hybrid antenna integrating with capacitive proximity sensors according to a further embodiment of the present invention.

Referring to FIG. 3, the radiator 1, the first capacitor electrode 3, and the second capacitor electrode 4 are disposed inside a casing of the handheld device (terminal device). Both the first capacitor electrode 3 and the second capacitor electrode 4 are disposed on the top of the handheld device (terminal device). In general, the circuit board which functions as the ground portion is substantially parallel to a screen of the handheld device. The first capacitor electrode 3 is located at the left half of the top, whereas the second capacitor electrode 4 is located at the right half of the top. The radiator 1 is disposed between the first capacitor electrode 3 and the second capacitor electrode 4. Referring to FIG. 4, in the embodiment of FIG. 4, the first capacitor electrode 3 is, for example, disposed on the front (which the screen is disposed on) of the handheld device, whereas the second capacitor electrode 4 is, for example, disposed on the back of the handheld device; hence, the first capacitor electrode 3 and the second capacitor electrode 4 are not only complementary in the proximity sensing range, but can also provide two or more sensing modes. Optionally, a third capacitor electrode 5 and a fourth capacitor electrode 6 are disposed on the left and right of the handheld device, respectively, to increase the proximity sensing range. The operating principle of the third capacitor electrode 5 and the fourth capacitor electrode 6 is similar to that of the first capacitor electrode 3 and the second capacitor electrode 4. In short, the third capacitor electrode 5 and the fourth capacitor electrode 6 are positioned proximate to the high-frequency radiating branch or the coupling portion (such as the first coupling portion) of the low-frequency radiating path of the radiator 1, so as to be coupled to energy, thereby exciting the coupling resonant mode.

In conclusion, a terminal device having a hybrid antenna integrating with capacitive proximity sensors, provided in embodiments of the present invention, effectuates proximity sensing at different points of the terminal device to increase a sensing range (or precision). The terminal device comprises two or more capacitor electrodes and thus provides diverse proximity sensing parameters. The hybrid antenna includes the two or more capacitor electrodes in order to be applicable to multi-band operation.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

The claims are as follows:

1. A terminal device having a hybrid antenna integrating with capacitive proximity sensors, the terminal device comprising:

a ground portion;

a radiator having a feeding portion, a low-frequency radiating path, and a high-frequency radiating branch, the low-frequency radiating path having a first coupling portion, the feeding portion being disposed between the first coupling portion and the ground portion, the high-frequency radiating branch functioning as a second coupling portion;

a first capacitor electrode having a first shorting portion and a first electrode portion, the first shorting portion being connected to the ground portion, wherein the first electrode portion is coupled to the first coupling portion of the low-frequency radiating path to generate a first coupling resonant mode; and a second capacitor electrode having a second shorting portion and a second electrode portion, the second shorting portion being connected to the ground portion, wherein the second electrode portion is coupled to the high-frequency radiating branch to generate a second coupling resonant mode;

wherein the first capacitor electrode and the second capacitor electrode are disposed on opposing sides of the radiator, respectively.

2. The terminal device of claim 1, wherein the terminal device is one of a smartphone, a notebook computer, and a tablet.

3. The terminal device of claim 1, wherein the first capacitor electrode is disposed on a first side of the ground portion, and the second capacitor electrode is disposed on a second side of the ground portion.

4. The terminal device of claim 1, wherein the low-frequency radiating path of the radiator generates a low-frequency resonant mode, and the high-frequency radiating branch of the radiator generates a high-frequency resonant mode, the low-frequency resonant mode having a lower frequency than the high-frequency resonant mode.

5. The terminal device of claim 4, wherein the first coupling resonant mode has a higher frequency than the second coupling resonant mode.

6. The terminal device of claim 5, wherein a frequency band at which the low-frequency resonant mode and the second coupling resonant mode operate is 824 M Hz to 960 M Hz, a frequency band at which the high-frequency resonant mode, the first coupling resonant mode, and an auxiliary resonant mode operate is 1710 MHz to 2170 MHz, and the auxiliary resonant mode at least comprises one of a first high-level mode of the second coupling resonant mode and a first high-level mode of the low-frequency resonant mode.

7. The terminal device of claim 1, wherein the radiator, the first capacitor electrode, and the second capacitor electrode are formed on a microwave substrate.

8. The terminal device of claim 7, wherein the first coupling portion and the first electrode portion of the first capacitor electrode are disposed on an upper side of the microwave substrate, the second high-frequency branch which functions as the second coupling portion and the second electrode portion of the second capacitor electrode are disposed on the upper side of the microwave substrate, the first shorting portion and second shorting portion are disposed on a lower side of the microwave substrate, the first shorting portion is connected to the first electrode portion by a first through hole, and the second shorting portion is connected to the second electrode portion by a second through hole.

9. The terminal device of claim 1, wherein the low-frequency radiating path of the radiator further has a common path and a low-frequency radiating branch, the first coupling portion and the common path of the low-frequency radiating path, and the high-frequency radiating branch together surround the low-frequency radiating branch of the low-frequency radiating path, wherein the low-frequency radiating branch falls within a region jointly enclosed by the first coupling portion, the common path, the high-frequency radiating branch, and the ground portion.

* * * * *